United States Patent [19]

Spivy

[11] 4,248,110

[45] Feb. 3, 1981

[54] APPARATUS FOR AND METHOD OF CUTTING A BELT SLEEVE

[75] Inventor: Paul L. Spivy, Rogersville, Mo.

[73] Assignee: Dayco Corporation, Dayton, Ohio

[21] Appl. No.: 60,097

[22] Filed: Jul. 24, 1979

[51] Int. Cl.[3] ..... B26F 3/00

[52] U.S. Cl. ..... 83/53; 83/177; 83/925 EB

[58] Field of Search ..... 83/53, 177, 925 EB

[56] References Cited

U.S. PATENT DOCUMENTS

| | | | |
|---|---|---|---|
| 1,611,781 | 12/1926 | Russell et al. | 83/925 EB X |
| 2,985,050 | 5/1961 | Schwacha | 83/177 X |
| 3,524,367 | 8/1970 | Franz | 83/177 X |
| 3,532,014 | 10/1970 | Franz | 83/177 X |
| 4,006,656 | 2/1977 | Shinomiya | 83/177 X |
| 4,007,652 | 2/1977 | Shinomiya et al. | 83/177 X |
| 4,152,958 | 5/1979 | Bogert | 83/177 X |

FOREIGN PATENT DOCUMENTS

| | | | |
|---|---|---|---|
| 599988 | 3/1978 | U.S.S.R. | 83/925 EB X |

*Primary Examiner*—Frank T. Yost

*Attorney, Agent, or Firm*—Charles E. Bricker; Reuben Wolk

[57] ABSTRACT

An apparatus for and method of cutting a substantially polymeric belt-defining sleeve to define a plurality of endless power transmission belt constructions are provided by rotating such belt sleeve on a rotating apparatus and cutting a plurality of axially spaced cuts through the sleeve with jet nozzle means disposed at a fixed position and with the jet nozzle means providing high velocity liquid jet means to define an endless power transmission belt construction between associated pairs of cuts.

16 Claims, 6 Drawing Figures

APPARATUS FOR AND METHOD OF CUTTING A BELT SLEEVE

BACKGROUND OF THE INVENTION

1. Field of the Invention

This invention relates to endless power transmission belts and in particular to an apparatus for and method of cutting a substantially polymeric belt defining sleeve with high velocity liquid jet means to define an encless power transmission belt construction or belt between associated pairs of cuts.

2. Prior Art Statement

In the art of manufacturing power transmission belt constructions it is common practice to make a belt-defining sleeve primarily of polymeric material whereupon such sleeve is disposed on a rotatable mandrel and mechanical cutting devices such as knife blades or rotary cutters are used to cut same and define a plurality of endless power transmission belts.

It is known in industry to utilize one or more high velocity liquid jets to cut materials of all types and having various strengths and physical characteristics. These materials range from soft materials, such as fabrics and sponge rubber at one extreme to metal sheets at the other extreme, with numerous materials including wood, rubber, plastics, stone, concrete, and the like in between these extremes.

It has also been proposed in U.S. Pat. No. 4,152,958, to employ fluid jets to cut rolls of material.

SUMMARY

It is a feature of this invention to provide an apparatus for cutting a substantially polymeric belt-defining sleeve to define a plurality of endless power transmission belt constructions.

Another feature of this invention is to provide an apparatus for cutting a sleeve of the character mentioned which employs rotating means for rotating the belt sleeve and employs high velocity liquid jet means to cut the belt sleeve during rotation thereof.

Another feature of this invention is to provide an apparatus of the character mentioned wherein the high velocity liquid jet means enables cutting of the substantially polymeric sleeve with minimum distortion thereof during cutting resulting in each of the endless power transmission belts cut from such sleeve having precisely formed side walls.

Another feature of this invention is to provide an improved method of cutting a substantially polymeric belt-defining sleeve to define a plurality of endless power transmission belt constructions.

Another feature of this invention is to provide a method of the character mentioned comprising rotating the belt sleeve on rotating means and cutting a plurality of axially spaced cuts through the sleeve with jet nozzle means disposed at a fixed position and with the jet nozzle means providing high velocity liquid jet means to define an endless power transmission belt between associated pairs of the cuts.

Another feature of this invention is to provide a method of the character mentioned wherein the high velocity liquid jet means enables cutting of the substantially polymeric sleeve with minimum distortion thereof during cutting resulting in each endless power transmission belts defined from such sleeve having precisely formed side walls.

Another feature of this invention is to provide a method of the character mentioned employing either a single high velocity liquid jet means or a plurality of such high velocity liquid jet means to define an endless power transmission belt between associated pairs of cuts made by the high velocity liquid jet means.

Another feature of this invention is to provide a method of the character mentioned wherein the belt-defining sleeve or belt sleeve has a tension section defining layer, a compression section defining layer, and a load-carrying section defining layer with the plurality of endless power transmission belt constructions each having a section corresponding to each of the layers of the belt sleeve.

Another feature of this invention is to provide a method of the character mentioned in which the cutting action employing high velocity liquid jet means is a simultaneous cutting and kerf removal action.

Therefore, it is an object of this invention to provide an improved apparatus for and method of cutting a substantially polymeric belt-defining sleeve to define a plurality of endless power transmission belt constructions with such apparatus and method having one or more of the novel features set forth above or hereinafter shown or described.

Other details, features, uses, objects, and advantages of this invention will become apparent from the embodiments thereof presented in the following specification, claims, and drawings.

BRIEF DESCRIPTION OF THE DRAWINGS

The accompanying drawings show present preferred embodiments of this invention, in which.

DETAILED DESCRIPTION

Figure 1:
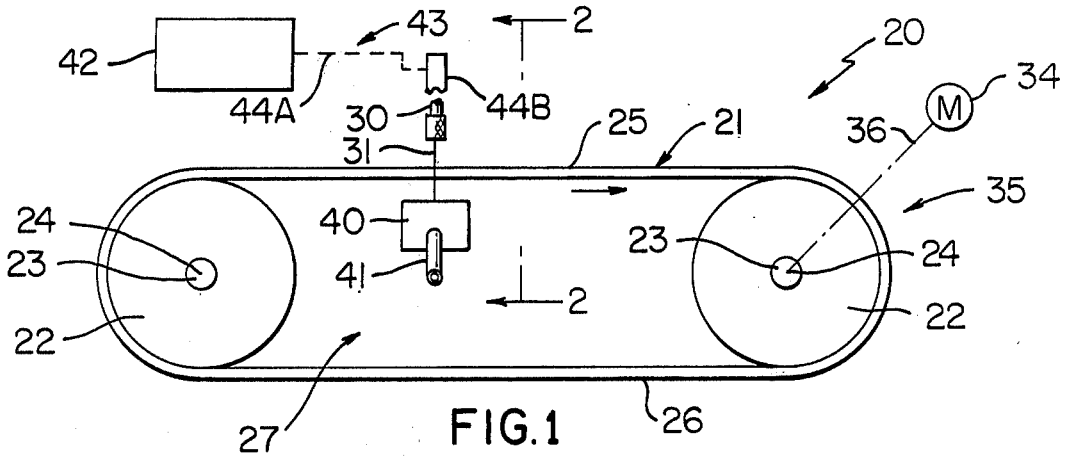
FIG. 1 is a view primarily in elevation and with certain parts shown schematically illustrating an exemplary embodiment of the basic apparatus and method of this invention.

Reference is now made to FIG. 1 of the drawings which illustrates one exemplary embodiment of an apparatus and method of this invention which is designated generally by the reference numeral 20 and such apparatus and method is particularly adapted to cut a belt-defining sleeve 21, which will be referred to hereinafter simply as a belt sleeve 21 to define a plurality of precision endless power transmission belt constructions or belts and as will be described in more detail subsequently.

The apparatus and method 20 comprises means for rotating the belt sleeve 21 and in this example of the invention such rotating means comprises a pair of cylindrical supports or cylinders each designated by the same reference numeral 22 and each having a central longitudinal support shaft 23. The cylinders 22 are disposed with their shafts 23 in spaced parallel relation and preferably in a horizontal plane and each cylindrical support 22 has a central longitudinal axis 24 which coincides with the corresponding axis of its shaft 23. The cylindrical supports 22 define a horizontal top part 25 of the sleeve, a horizontal bottom part 26, and a space 27 between the cylindrical supports 22 and the top and bottom parts 25 and 26.

Figure 2:
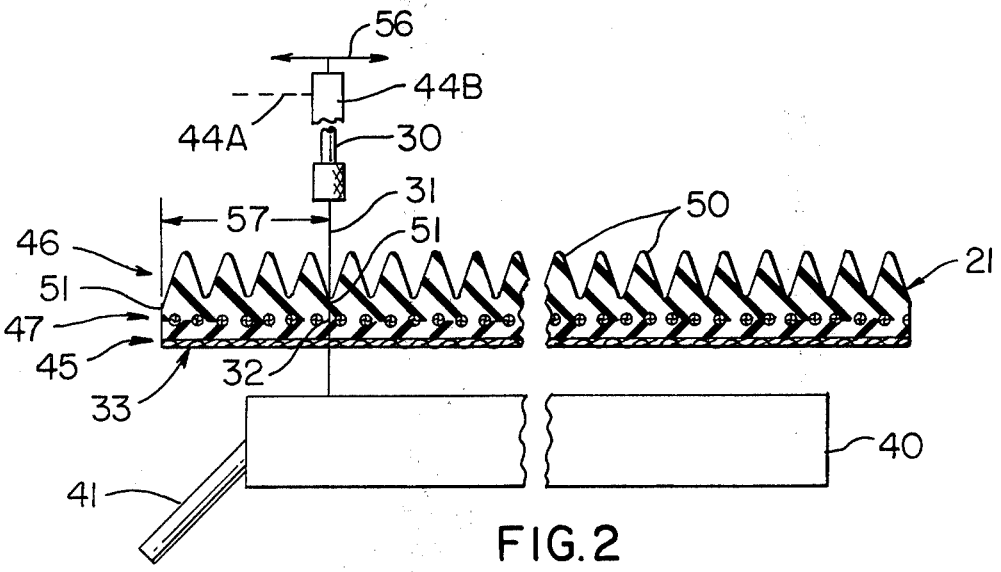
FIG. 2 is a fragmentary cross-sectional view taken essentially on the line 2—2 of FIG. 1 showing the exemplary embodiment of the apparatus and method of FIG. 1 employing a single high velocity liquid jet to cut one type of a belt-defining sleeve.

The apparatus and method 20 includes jet nozzle means 30 disposed at a fixed position relative to the belt sleeve 21 and as shown in FIGS. 1 and 2 the jet nozzle means 30 provides a high velocity liquid jet means 31 which provides the cutting action. In the illustrations of FIGS. 1 and 2 the jet nozzle means is a single jet nozzle 30 which provides a single liquid jet 31 and the high velocity liquid jet 31 defines an associated cut 32 once it is directed against or impinged on the belt sleeve 21 to thereby define an endless power transmission belt 33 (FIG. 2) between an associated pair of cuts 32.

The cutting action or provision of each cut 32 is achieved by rotating the belt sleeve 21 employing the rotatable cylindrical supports 22 while simultaneously directing the high velocity jet 31 against the sleeve 21. The rotation of the supports 22 is achieved by rotating the support shaft 23 of at least one of the cylindrical supports (the right support of FIG. 1) employing a motor 34 which is operatively connected to the shaft 23 as shown at 35 by a mechanical connection 36.

The apparatus and method 20 utilizes a container 40 which is provided and supported in the space 27, for receiving the high velocity liquid jet 31 and dissipating the remaining energy of such liquid jet. The liquid which is used to define the jet 31 is then discharged from the container 40 through a discharge pipe 41 or the like. Further, the container 40 may have suitable energy-absorbing means to help dissipate the energy of the high velocity jet 31.

The jet nozzle means or jet nozzle 30 is provided with liquid at high pressure employing a suitable pressurizing system which is shown schematically by a rectangular block in FIG. 1 and designated generally by the reference numeral 42. Because the system 42 is known in the art, its operation and the components thereof will not be described herein in detail. However, a suitable fluid conduit means 43 comprising a fluid conduit 44A and a shut-off valve 44B is provided in flow communication between the system 42 and the nozzle 30. The conduit means 43 provides liquid to the nozzle 30 which exudes as the high velocity jet 31.

The high velocity liquid jet 31 is provided by the cooperating action of the system 42, conduit means 43, and nozzle 30. The nozzle 30 comprises a suitable precision orifice defining the outlet thereof and such orifice is constructed so as to define a jet; and, the orifice and thus its jet may have a diameter ranging between 0.001 inch and 0.050 inch. For a jet having a diameter in this range the pressure provided through conduit 43 by the system 42 may range between 10,000 and 100,000 pounds per square inch gage (psig).

The apparatus and method 20 may be employed to cut belt-defining sleeves or belt sleeves of various types and such apparatus and method provides belts of high precision due to the cutting action. In the illustration of FIG. 2 the belt sleeve comprises a tension section defining layer 45, a compression section defining layer 46, and a load-carrying section defining layer 47 sandwiched between the layers 45 and 46. The compression section defining layer 46 is essentially a toothed or ribbed layer having a plurality of endless longitudinal ribs of roughly triangular cross-sectional outline defining the outer part of layer 46 and each rib is designated by the reference numeral 50.

The high velocity liquid jet 31 is employed and directed perpendicular to the top part 25 of the sleeve 21 to define a plurality of endless belts from the sleeve 21 by first providing a cut 32 at a side edge of the sleeve which defines a side wall or side 51 of a ribbed belt 33 while simultaneously removing excess kerf or trimming the sleeve 21. The cutting action is achieved simply by providing the high velocity liquid jet 31 while rotating the belt sleeve utilizing the motor 34 and once the sleeve 21 is rotated one complete revolution with the jet 31 impinged thereagainst the cutting action for one cut 32 is complete.

The jet nozzle 30 is then moved axially along the belt sleeve 21, i.e., perpendicular to the plane of the paper in the example of FIG. 1, employing suitable moving means indicated schematically by a double arrow 56 attached to the shut off valve 44B. The axial movement is achieved with the system 42 turned off, or the valve 44B closed, for a predetermined increment, or distance, indicated at 57 which defines the width of the belt 33 having a plurality of four triangular belt elements in its compression section whereupon the system 42 is then energized with the valve 44B open to provide the high velocity liquid jet 31 from the jet nozzle 30 and simultaneously the motor 34 is energized to provide another cut 32 and define the opposite side wall or side 51 of the endless power transmission belt 33. The above operation is repeated across the full width of the sleeve 21 to define a belt 33 between each associated pair of cuts 32. It will be noted that the high velocity liquid jet 31 is disposed perpendicular to the horizontal portion 25 of the belt sleeve 21 whereby the side walls 51 are also disposed substantially perpendicular to the inside and outside surfaces of the belt 33.

Figure 3:
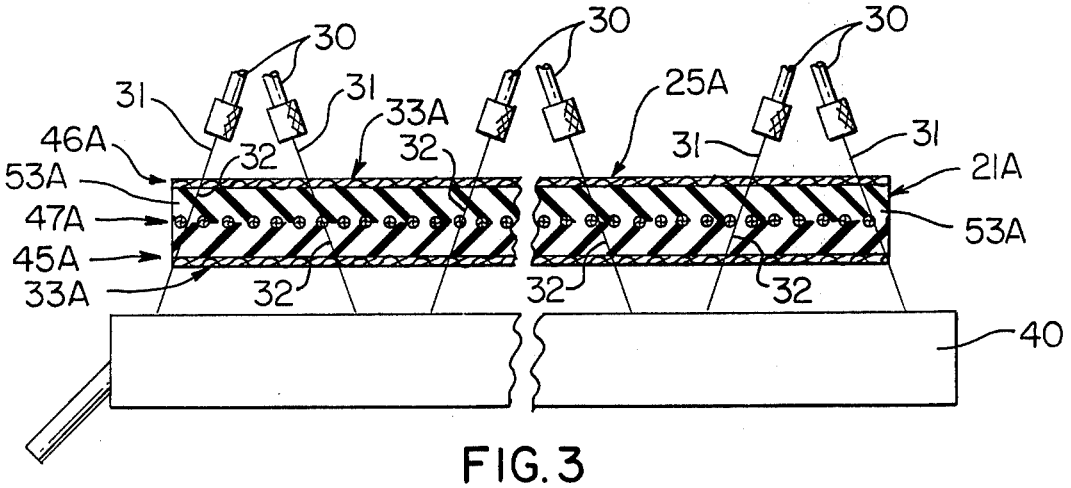
FIG. 3 is a view similar to FIG. 2 showing a modification of the apparatus and method used to cut another type of a belt-defining sleeve wherein a plurality of liquid jet means is used to cut the entire belt sleeve in a simultaneous manner with one rotation of the belt sleeve.

A modification of the apparatus and method 20 of this invention is illustrated, in part, in FIG. 3 and used to cut another embodiment of a belt sleeve which is designated generally by the reference numeral 21A. The sleeve 21A is of the type which is cut employing a plurality of balanced cuts to define a plurality of belts 33A of the so-called central neutral axis type, i.e., the load-carrying section in each belt 33A is disposed midway between the opposed inside and outside surfaces of the belt, hence the opposed surfaces of the belt sleeve.

The belt sleeve of FIG. 3 has a tension section defining layer 45A and a compression section defining layer 46A which, in essence, are identical layers and a load-carrying section defining layer 47A disposed midway therebetween. Although, the layer 45A is referred to as a tension section defining layer, it will be appreciated that because balanced cuts 32 are provided in the sleeve 21A, as will subsequently be described, the layer 45A defines the tension sections of alternate belts across the belt sleeve 21A and the compression sections of those belts disposed between such alternate belts. Similarly, the layer 46A defines the compression sections of alternate belts across the belt sleeve 21A and the tension sections of those belts disposed between the alternate belts.

The modified apparatus of FIG. 3 employs a plurality of jet nozzles 30 which are disposed at fixed positions above the sleeve 21A and angled as shown so that the high velocity jets 31 from the nozzles 30 define balanced cuts 32 in belt sleeve 21A. The jet nozzles 30 extend across the full width of the belt sleeve 21A and the liquid from the high velocity liquid jets 31, after penetrating through the belt sleeve 21A, is caught in the container 40 disposed beneath the top portion 25A of the sleeve 21A.

The cutting of the belt sleeve 21A is achieved by cutting all belts therefrom in a simultaneous manner. This is achieved simply by rotating a rotatable support cylinder 23, as described earlier, employing the motor 34 while simultaneously providing high pressure fluid from the system 42 to all of the jet nozzles 30 through conduit means which comprises a plurality of conduits and at least one shut-off valve which flow isolates the nozzles 30. The conduit means may include a common manifold, not shown, connected to the system 42. With the system 42 in operation and the conduit means providing fluid at high pressure to the nozzles 30, the motor 34 is energized and with one complete revolution of the belt sleeve 21A the entire belt sleeve is cut in a simultaneous manner. The cutting action provides a plurality of belts 33A of the type having a central neutral axis while defining a pair of annular scrap members 53A each of triangular cross-sectional configuration.

Figure 4:
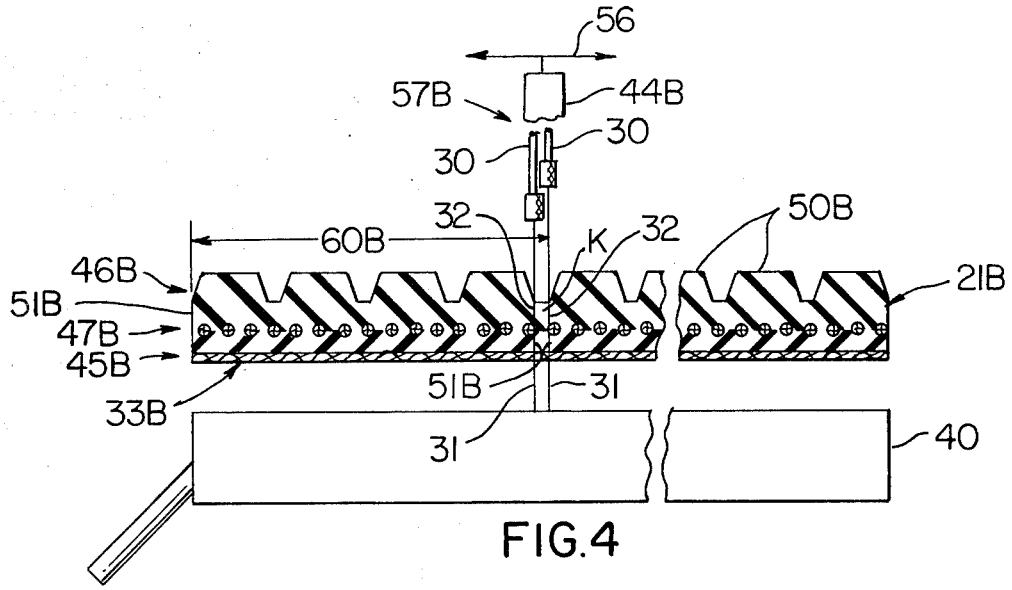
FIG. 4 is a view similar to FIG. 2 showing another modification of the apparatus and method used to cut another type of a belt-defining sleeve wherein a cooperating pair of high velocity liquid jet means provides a simultaneous cutting action and kerf removal.

Another modification of the apparatus and method 20 of this invention is illustrated, in part, in FIG. 4 of the drawings which illustrates another embodiment of a belt-defining sleeve or belt sleeve 21B. The belt sleeve 21B has a tension section defining layer 45B, a compression section defining layer 46B, and a load-carrying section defining layer 47B disposed in sandwiched relation between the tension and compression section defining layers 45B and 46B respectively. The layer 46B has a plurality of annular ribs or elements 50B of roughly trapezoidal cross-sectional outline. The belt sleeve 21B is cut essentially utilizing the apparatus and method of FIG. 1 and modified to utilize a pair of cooperating nozzles 30 which are controlled by a single shut-off valve 44B and operated as a single unit 57B to provide simultaneous cutting and removal of excess material or kerf K between an associated pair of annular belt ribs or elements 50B of its compression section defining layer.

The cutting of the belt sleeve 21B is very similar to the cutting of the belt sleeve 21. Accordingly, a pair of parallel cuts 32 (not shown) which remove kerf, are provided at the far left of the sleeve 21B as shown in FIG. 4. The unit 57B with its two jet nozzles is then moved axially along the sleeve 21B a predetermined distance 60B and the high velocity jets 31 turned on while rotating the sleeve 21B one revolution to define a belt 33B having opposed side walls 51B. The belt 33B has a plurality of four endless parallel ribs or belt elements of trapezodial outline defining the outer part of its compression section.

Figure 5:
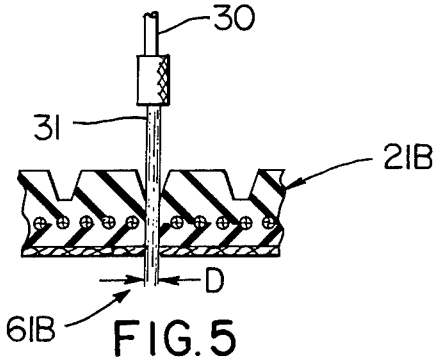
FIG. 5 is a fragmentary view similar to a portion of FIG. 4 illustrating the belt-defining sleeve of FIG. 4 being cut by a single high velocity liquid jet having a width which is sufficient to provide both a cutting and a kerf removal or trimming action.

A further modification of the apparatus and method of FIG. 4 is illustrated in FIG. 5 of the drawings wherein the nozzle 30 comprising the apparatus and method 20 provides a high velocity jet 31 of substantial diameter D exuding therefrom. The high velocity jet 31 of FIG. 5 is used in lieu of the two jets 31 from the two jet nozzles 30 shown in FIG. 4 to provide, with a single jet, a cutting action and the removal of the kerf from between associated trapezoidal elements 50B as shown at 61B.

Figure 6:
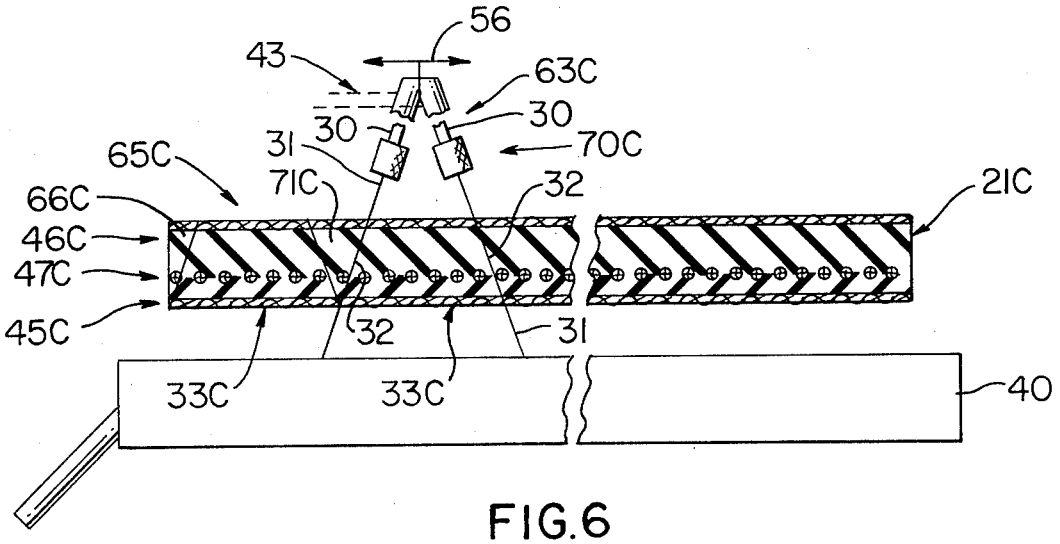
FIG. 6 is a view similar to FIG. 2 illustrating another modification of the apparatus and method used to cut another type of belt-defining sleeve and wherein a cooperating pair of angularly disposed high velocity liquid jet means is used to provide the cutting action.

Reference is now made to FIG. 6 of the drawings which partially illustrates still another modification of the apparatus and method 20 of this invention which is used to cut a belt sleeve 21C. The belt sleeve 21C has a tension section defining layer 45C, a compression section defining section layer 46C, and a load-carrying section defining layer 47B disposed in sandwiched relation between layers 45C and 46C. An assembly of jet nozzles comprised of a pair of jet nozzles is operated as a unit 63C for cutting the belt sleeve 21C to define an endless power transmission belt 33C between each associated pair of cuts 32 defined by the two high velocity liquid jets 31 exuding from the two nozzles 30.

To define each belt 33C the belt sleeve 21C is rotated utilizing the motor 34 in the manner previously described and with the system 42 providing high pressure liquid through the conduit means 43 to thereby provide the high velocity jets 31 from the two angularly disposed jet nozzles 30. As the belt sleeve 21C is rotated one revolution a belt 33C is defined between an associated pair of cuts 32 as shown at 65C in FIG. 6 while simultaneously defining an annular scrap member 66C of triangular cross-sectional configuration. The high velocity jets 31 from unit 63C are then turned off and the unit 63C moved axially by moving means 56, along the belt sleeve 21C a predetermined distance so as to define the next belt 33C (as shown at 70C) along the belt sleeve 21C with annular piece of scrap 71C of substantially triangular cross-sectional configuration between the belt 33C last defined and the belt shown at 65C. This process is repeated across the full axial length of the sleeve 21C so as to define all belts therein. Each belt 33C defined from the belt sleeve 21C is of the more commonly used construction and has a trapezoidal cross section with its load-carrying section disposed more closely adjacent the outside surface of the tension section than to the outside surface of its compression section.

Each belt 33C is defined in FIG. 6 by a pair of cooperating jet nozzles provided as an assembly or unit 63C which is moved axially along the sleeve 21C. However, all belts 33C to be cut from the sleeve 21C may be cut in a similar manner as described in connection with the belt sleeve 21A of FIG. 3 whereby all such belts may be cut in a simultaneous manner using a plurality of units 63C suitably disposed across the sleeve 21C and during one revolution thereof as provided by the motor 34.

Likewise, the ribbed belt sleeve 21 of FIG. 2 and the ribbed belt sleeve 21B of FIG. 4 may each be cut in a simultaneous manner during one revolution of the sleeve employing a plurality of jet nozzles as described in connection with the belt sleeve 21A of FIG. 3.

As previously indicated it is known in the art to provide apparatus comprised of the system 42, conduit means or system 43, and a jet nozzle 30 which provides a high velocity jet 31 or the like. For example, two companies which have satisfactorily produced and sold such apparatus are the Flow Equipment Corporation, 1819 South Central Avenue, Kent, Washington, 98031 and the McCartney Manufacturing Co., Inc. 635 West 12th St., Baxter Springs, Kan. 66713.

In cutting a belt sleeve utilizing the usual mechanical knife or mechanical rotary cutter a substantial distortion is achieved during the cutting action and such distortion is due to the compression of the knife or cutter against the polymeric material of the belt sleeve as well as the thickness and configuration of the knife or cutter itself. Accordingly, with the conventional mechanical knife or cutter, it is not possible to provide a precisely formed sidewall, particularly in a belt of trapezoidal cross section. However, with the apparatus and method of this invention the resulting trapezoidal belt will have side walls which are of nearly perfect trapezoidal cross-sectional configuration and such belt may be operated in associated sheaves with minimum tendency for wear and minimum tendency for the belt to slip or turn over.

It is also apparent as disclosed in connection with FIGS. 4 and 5 of the drawings that the apparatus and method of this invention provides simultaneous cutting as well as removal of excess kerf or excess material in one operation.

The liquid used to define the high velocity liquid jet of this invention may be plain tap water. In addition, the tap water may have a long chain polymer added thereto to provide a more cohesive high velocity jet.

Reference was made previously herein to the cutting of the belt sleeves 21, 21A, 21B, and 21C and such sleeves are made primarily of polymeric material as is known in the art. This means that the major part of each sleeve and hence the major part of each belt defined therefrom is made from a suitable polymeric material. Further, the polymeric material may be in the form of either a natural or synthetic rubber compound or a suitable synthetic plastic material. Reinforcing means, such as one or more fabric outer cover and load-carrying means may be provided as is known in the belt making art.

In this disclosure of the invention, the belt constructions defined are in the form of final belts which are cut from the various sleeves 21, 21A, 21B, and 21C after curing thereof; however, it will be appreciated that the apparatus and method of this invention may be employed in defining belt constructions which may be further processed. For example, it may be desired to cut fabric material employing one or more high velocity liquid jets and such fabric material may be utilized to build up a tubular construction defining a belt sleeve. Similarly, sheets of uncured rubber material may be similarly cut utilizing high velocity jet means. Finally, high velocity jet means may be utilized to cut uncured annular members, or the like, and such members may be wrapped and cured as is known in the art to define a completed belt construction.

In this disclosure, each of the belts 33 and 33B is shown with a ribbed compression section comprised of a plurality of annular ribs and in each instance four annular ribs or elements are illustrated; however, it is to be understood that the apparatus and method of this invention may be utilized to define belt constructions in which any desired plurality of annular ribs may be defined in the compression section thereof.

While present exemplary embodiments of this invention, and methods of practicing the same, have been illustrated and described, it will be recognized that this invention may be otherwise variously embodied and practiced within the scope of the following claims.

What is claimed is:

1. In a method of cutting a substantially polymeric belt-defining sleeve having a tension section defining layer, a compression section defining layer, and a load-carrying section defining layer to define a plurality of endless power transmission belt constructions each having a section corresponding to each of said layers, the improvement comprising the steps of, rotating said belt sleeve on rotating means, and cutting a plurality of axially spaced cuts through said layers with jet nozzle means disposed at a fixed position, said jet nozzle means providing high velocity liquid jet means to define an endless power transmission belt between associated pairs of said cuts, said high velocity liquid jet being provided by providing orifice means ranging between 0.001 and 0.050 inch in diameter in said jet nozzle means and supplying liquid at a pressure ranging between 10,000 and 100,000 psig to said orifice means to define said high velocity liquid jet means therethrough, said high velocity liquid jet means enabling cutting of said substantially polymeric sleeve with minimum distortion thereof during cutting resulting in each endless power transmission belt having precisely formed side walls.

2. A method as set forth in claim 1 in which said rotating step comprises rotating said belt sleeve on a pair of cylindrical supports disposed with their axes in spaced parallel relation and defining a top part of said sleeve, a bottom part of said sleeve, and a space between said supports and said top and bottom parts, said cutting step comprising disposing said jet nozzle means above said top part and directing said liquid jet means toward said bottom part.

3. A method as set forth in claim 2 and comprising the further step of disposing a container in said space for receiving liquid from said liquid jet means, said container having means dissipating the remaining energy of said liquid jet means.

4. A method as set forth in claim 3 in which said cutting step comprises providing a single jet nozzle which defines said liquid jet means as a single liquid jet and moving said jet nozzle in predetermined space increments axially along said belt sleeve prior to ejecting said single liquid jet therefrom to define said plurality of cuts.

5. A method as set forth in claim 3 in which said cutting step comprises providing a plurality of jet nozzles which define said liquid jet means as a corresponding plurality of liquid jets.

6. A method as set forth in claim 5 in which said cutting step comprises rotating said belt sleeve one revolution beneath said jet nozzles enabling said plurality of liquid jet means to cut the entire belt sleeve in a simultaneous manner during said revolution.

7. A method as set forth in claim 1 in which said substantially polymeric belt-defining sleeve has said compression section defining layer provided with a plurality of spaced ribs disposed in parallel relation, and said cutting step results in defining an endless power transmission belt between each associated pair of ribs wherein each belt has a plurality of longitudinally extending ribs between each associated pair of cuts.

8. A method as set forth in claim 1 in which said substantially polymeric belt-defining sleeve has its tension section defining layer and compression section defining layer of substantially identical construction and said load-carrying section defining layer is disposed midway between said above-named two layers, and said cutting step results in defining an endless power transmission belt of the central neutral axis type between each associated pair of cuts.

9. A method as set forth in claim 1 in which said substantially polymeric belt defining sleeve is of conventional construction wherein said load-carrying section is disposed more closely adjacent to the outside surface of the tension section defining layer than to the outside surface of the compression section defining layer, and said cutting step results in defining an endless power transmission belt of conventional construction between each associated pair of cuts.

10. A method as set forth in claim 1 in which said jet nozzle means provides high velocity water jet means.

11. A method as set forth in claim 1 in which said jet nozzle means provides high velocity water jet means comprised of water having a long-chain polymer mixed therein.

12. In an apparatus for cutting a substantially polymeric belt-defining sleeve having a tension section defining layer, a compression section defining layer, and a load-carrying section defining layer, to define a plurality of endless power transmission belt constructions each having a section corresponding to each of said layers, the improvement comprising, means rotating said belt sleeve, jet nozzle means disposed at a fixed position and for cutting a plurality of axially spaced cuts through said layers, said jet nozzle means providing high velocity liquid jet means to define an endless power transmission belt between each associated pair of said cuts, said jet nozzle means comprising orifice means ranging in diameter between 0.001 and 0.050 inch, and means supplying a liquid at a pressure ranging between 10,000 and 100,000 psig to said orifice means to define said high velocity liquid jet means therethrough, said high velocity liquid jet means enabling cutting of said substantially polymeric sleeve with minimum distortion thereof during cutting resulting in each endless power transmission belt having precisely formed side walls.

13. An apparatus as set forth in claim 12 in which said means rotating said belt sleeve comprises a pair of rotatable cylindrical supports disposed with their axes in spaced parallel relation and defining a top part of said sleeve, a bottom part of said sleeve, and a space between said supports and top and bottom parts; and said apparatus further comprises means supporting said jet nozzle means above said top part so that said liquid jet means is directed against said top part and toward said bottom part during cutting of said belt sleeve; and a container supported in said space for receiving liquid from said liquid jet means, said container having means dissipating the remaining energy of said liquid jet means.

14. An apparatus as set forth in claim 13 in which said jet nozzle means consists of a single jet nozzle which defines said liquid jet means as a single liquid jet and means moving said jet nozzle in predetermined spaced increments axially along said belt sleeve prior to ejecting said single liquid jet therefrom to define said plurality of cuts.

15. An apparatus as set forth in claim 13 in which said jet nozzle means consists of a plurality of jet nozzles which define said liquid jet means as a corresponding plurality of liquid jets.

16. An apparatus as set forth in claim 13 in which said means for rotating said belt sleeve comprises a motor for rotating at least one of said supports.

* * * * *